US005638608A

United States Patent [19]

Dorber

[11] Patent Number: 5,638,608

[45] Date of Patent: Jun. 17, 1997

[54] METHOD FOR STYLING/DRYING HAIR FOR AN AIR-MOVING APPLIANCE FOR PERSONAL USE

[75] Inventor: Ralf Dorber, Schmitten, Germany

[73] Assignee: Braun Aktiengesellschaft, Kronberg, Germany

[21] Appl. No.: 486,483

[22] Filed: Jun. 7, 1995

Related U.S. Application Data

[63] Continuation of Ser. No. 232,241, filed as PCT/EP93/03082 Nov. 4, 1993, Pat. No. 5,457,894.

[30] Foreign Application Priority Data

Dec. 22, 1992 [DE] Germany ..... 42 43 640.0

[51] Int. Cl.[6] ..... A45D 20/00

[52] U.S. Cl. ..... 34/283; 132/116; 132/118; 34/98

[58] Field of Search ..... 34/90, 283, 98, 34/99, 101, 97; 132/112–116, 118

[56] References Cited

U.S. PATENT DOCUMENTS

| | | | |
|---|---|---|---|
| D. 323,039 | 1/1992 | Lerner | D28/13 |
| D. 354,152 | 1/1995 | Mathews | D28/18 |
| 3,083,715 | 4/1963 | Trabish | 132/33 |
| 3,970,093 | 7/1976 | Lardenois | 132/9 |
| 4,295,283 | 10/1981 | Tomaro | 34/97 |
| 4,730,361 | 3/1988 | Koffler | 15/160 |
| 4,759,135 | 7/1988 | Scivoletto | 34/97 |
| 5,060,398 | 10/1991 | Wolens | 34/97 |
| 5,191,907 | 3/1993 | Hirzel | 132/107 |
| 5,212,366 | 5/1993 | McDougall | 34/97 |
| 5,275,339 | 1/1994 | Andis et al. | 34/98 |

FOREIGN PATENT DOCUMENTS

| | | | |
|---|---|---|---|
| 0 103 205 A1 | 3/1984 | European Pat. Off. | A46B 9/02 |
| 0 103 205 B1 | 8/1986 | European Pat. Off. | A46B 9/02 |
| 0 439 781 A1 | 8/1991 | European Pat. Off. | A45D 20/12 |
| 1 818 818 | 7/1960 | Germany | A45D 20/00 |
| 27 28 406 | 1/1978 | Germany | A45D 20/00 |
| 41 09 775 A1 | 10/1991 | Germany | A45D 20/10 |
| 9012981.4 | 2/1992 | Germany | A45D 20/12 |
| 9100180 U | 6/1992 | Germany | A45D 20/12 |
| 41 00 398 | 7/1992 | Germany . | |
| 2 230 184 | 10/1990 | United Kingdom . | |
| WO89/09554 | 10/1989 | WIPO . | |
| DM/021 436 | 12/1991 | WIPO | 28/3 |
| WO92/117831 | 7/1992 | WIPO | A45D 20/12 |

OTHER PUBLICATIONS

Package box panels to Helen of Troy Model 1424 Styling Pik/Diffuser Attachment © 1989 (6 panels).

Use and Care Instruction Manual to Helen of Troy Model 1424 Styling Pik/Diffuser Attachment (2 pages)© 1989.

(A.) Model 2222 "Softstyle" EuroStyle Diffuser and (E.) Model 2224 Pik/Diffuser at fifth (unnumbered) page, of Helen of Troy Corp. Catalog © 1990 (8 pp.).

Braun Silencio Control Diffuser 1600 PFV 1600 DFB4: Use Instructions (2pp.)(undated prior art).

Braun Silencio Control Diffuser 1600 PFV 1600 DFB4: Styling Instructions "Braun and a Beautiful You", two sets of illustrations numbered 1–17 (8pp.)(undated prior art).

Severin Program 1989 Catalog cover sheet and p. 44 showing several hair curling brushes (2 pages).

Brush Attachment (3 photographic views labeled "Anlage 3b Originalmuster")(undated prior art).

*Primary Examiner*—Henry A. Bennett
*Assistant Examiner*—Susanne C. Tinker
*Attorney, Agent, or Firm*—Edward S. Podszus

[57] ABSTRACT

The invention is directed to a method of use for an air-moving appliance for personal use, in particular a hair dryer or a hot-air curling brush, comprising a body (10) and a two-dimensional air discharge means (12) which includes a series of air exit apertures (14) and carries a series of hair pickup elements (16) arranged adjacent to each other. Downward ends (18) of the hair pickup elements (16) lie on a substantially concave surface.

22 Claims, 3 Drawing Sheets

OTHER PUBLICATIONS

Use instructions for EWT (Elektro–Wärme–Technik Company) "Soft Dryer" Model SD 5043, undated.

Package box panels of EWT (Elektro–Wärme–Technik Company) "Soft Dryer 1400W, Model SD 5043 Set", undated.

Photograph of EWT (Elektro–Wärme–Technik Company) Model SD 5043 "Comb attachment".

Use Instructions for Toshiba hair appliance HDL–B730, HDL–B731, HDL–B732, covers and pp. 1–8, undated (Japanese language).

Boots Christmas Gift Guide 1991 (p. 3) showing "Babyliss Lightweight Professional Dryer and Diffuser".

Three Views from an Engineering Drawing of a Diffuser, latest revision dated May 3, 1990.

Product literature for Babyliss "Volum' Air" hair appliance, 3 pages (undated).

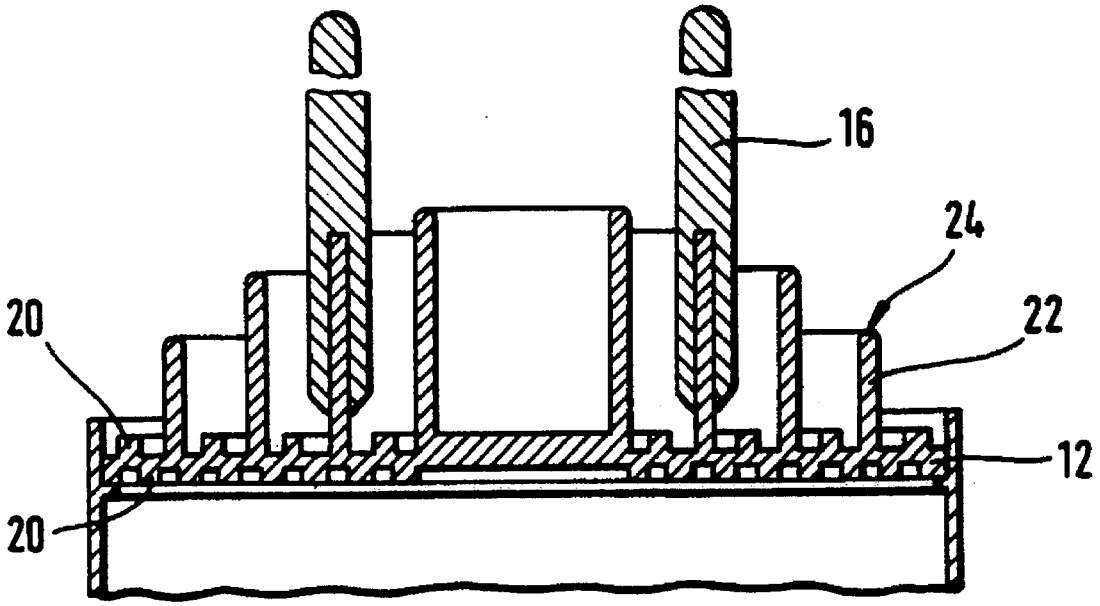
Fig. 4
Fig. 5
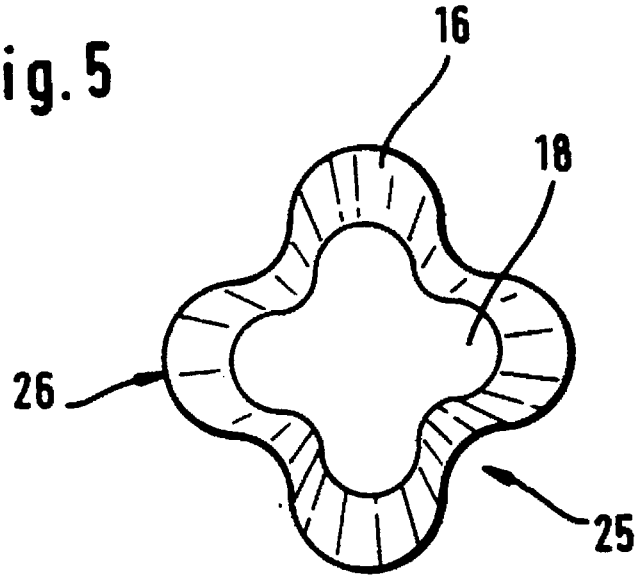

METHOD FOR STYLING/DRYING HAIR FOR AN AIR-MOVING APPLIANCE FOR PERSONAL USE

This application is a continuation of Ser. No. 08/232,241, now U.S. Pat. No. 5,457,894 issued Oct. 7, 1994, filed Aug. 8, 1994, which is a 371 of PCT/EP93/03082, filed Nov. 04, 1993.

This invention relates to an implement for styling/drying hair for an air-moving appliance for personal use, in particular a hair dryer or a hot-air curling brush, comprising a body and a two-dimensional air discharge means which includes a series of air exit apertures and carries a series of hair pickup elements arranged adjacent to each other.

Such a hair styling implement is already known from printed specification GB 22 30 184 B. This implement is securable to a conventional hand-held hair dryer. The front face of the attachment includes a plurality of projecting prongs and air vent apertures. This device is intended to be suitable for untangling the hair as it is dried, for example. Because the prongs decrease in length radially outwardly from the center of the attachment, the user has difficulty in manipulating the device, and styling/drying of the hair is not conveniently accomplishable. In addition, only a small region of the hair can be picked up and styled/dried, making it a time-consuming and fatiguing task for its user.

By contrast, it is an object of the present invention to improve upon the known implement such as to improve the treatment of the hair and simplify the manipulation of the device for its user. This object is essentially accomplished in that downstream ends of the hair pickup elements lie on a substantially concave surface. When the implement mounted on the hair dryer is moved in the hair using light circular motions, the hair will be caught by the hair pickup elements, entering the space intermediate thereof. As a result of this movement, more hair will be caught and lifted in the direction of the air discharge means, causing the hair to be fluffed out in the space between the hair pickup elements. The exiting air will dry the hair in this position. As a result, the hair will be given a better stand in its root area. Greater fullness and body will be imparted to the hair. The circular motion of the hair pickup elements has an added massage effect, producing a pleasant feel on the scalp. Further, at least several hair pickup elements will engage the user's scalp in use of the implement, enabling a larger section of hair to be caught for styling/drying so that, overall, the duration of the styling/drying process is reduced.

Because those hair pickup elements that are arranged in an outer region, in particular an edge segment of the air discharge means, are of greater length than the hair pickup elements that are arranged in an inner region of the air discharge means, the ends of the hair pickup elements are disposed in an imaginary inclined plane, simplifying the manipulation of the implement still further. Arranging the fingers of different lengths in this manner enables the implement to cover also parts of the head which are otherwise hard to reach or the hair root area in the neck with ease, styling/drying the hair in these areas.

In an advantageous embodiment of the present invention, the concave surface is a portion of a spherical surface, the sphere diameter corresponding approximately to the mean diameter of a person's head. The surface being approximated to the shape of a person's head, substantially all hair pickup elements are in contact with the scalp in use of the implement. This enables a larger section of the hair to be styled and dried.

Advantageously, the air discharge means is of a convex configuration, enabling the hair to glide over the air discharge means as the device is used. This increases the hair's shine.

In an embodiment of the present invention, the hair pickup elements are arranged on concentric circular rings relatively spaced at approximately equal distances. This approximately uniform distribution of the hair pickup elements provides a sufficient distance between the hair pickup elements for catching individual strands of hair, in addition to ensuring an effective utilization of the surface of the air discharge means.

In an advantageous embodiment of the present invention, the hair pickup elements are arranged on the air discharge means in the form of two quadrangles disposed in a 90° offset relation to each other, their sides being curved in a concave fashion relative to a center of the air discharge means. Arranging the hair pickup elements in this manner is particularly advantageous when the implement is guided so as to engage within the hair close to the head from the side, as for dry combing and smoothing longer hair. The diameter of curvature of the sides is approximated to the mean diameter of a person's head, enabling all hair pickup elements on one side to be held close to the scalp and thus sufficiently large sections of hair to be caught.

Advantageously, the concave sides of the quadrangles correspond approximately to the arcs of a circle. As a result, a series of hair pickup elements will engage the hair also in cases where the hair styling/drying implement is held at an inclination, enabling even awkward-to-reach hair sections to be readily caught and styled by the implement.

Because the air discharge means is formed by circular rib members disposed in offset relation to each other in two planes, the exiting air will be swirled, slowing the airflow. This prevents the undesired effect of hair being upset as it is dried or styled.

Advantageously, the rib members are at least in part configured as annular walls of different heights, thereby adding to the uniformity of the exiting air stream and improving the styling and drying effect, particularly also the combing of the hair.

In an advantageous further feature, downstream end portions of the annular walls lie on a convex surface. As a result of this configuration, the hair is guided over these end portions as it is combed and/or smoothed, for example, utilizing a maximum surface and thus adding luster to the hair.

In a further embodiment of the present invention, the hair pickup elements are fixedly secured to the rib members. As a result, the air exiting intermediate the annular walls impinges directly on the hair that has entered the space between hair pickup elements, which has a beneficial effect on the styling and drying process.

According to an advantageous further feature of the present invention, the ratio of the length of the hair pickup elements to a mean diameter thereof is greater than about 5 to 1, preferably 8 to 1. This ratio is conducive to improving the desired effects including, for example, the obtainment of a better stand of the hair in the root area, particularly also where short hair is involved.

According to a still further feature of the present invention, the hair pickup elements are preferably of a star-shaped cross section with rounded edges. Shaping the hair pickup elements in this manner increases the number of edges engaging the hair, enabling a slight pull to be exerted on the hair and the smoothing effect to be improved, particularly where long hair is combed. In addition, this shape is advantageous from the injection-molding engineering point of view.

Further objects, features, advantages and application possibilities of the present invention will become apparent from the subsequent description of embodiments. It will be understood that all features described and/or represented by illustration, whether taken alone or in any desired combination, constitute the subject-matter of the present invention, irrespective of their summarization in the claims or their back-references.

In the drawings,

FIG. 4 is a schematic illustration, in section, of a second embodiment of the present invention; and FIG. 5 is an enlarged top plan view of a hair pickup element.

Figure 1:
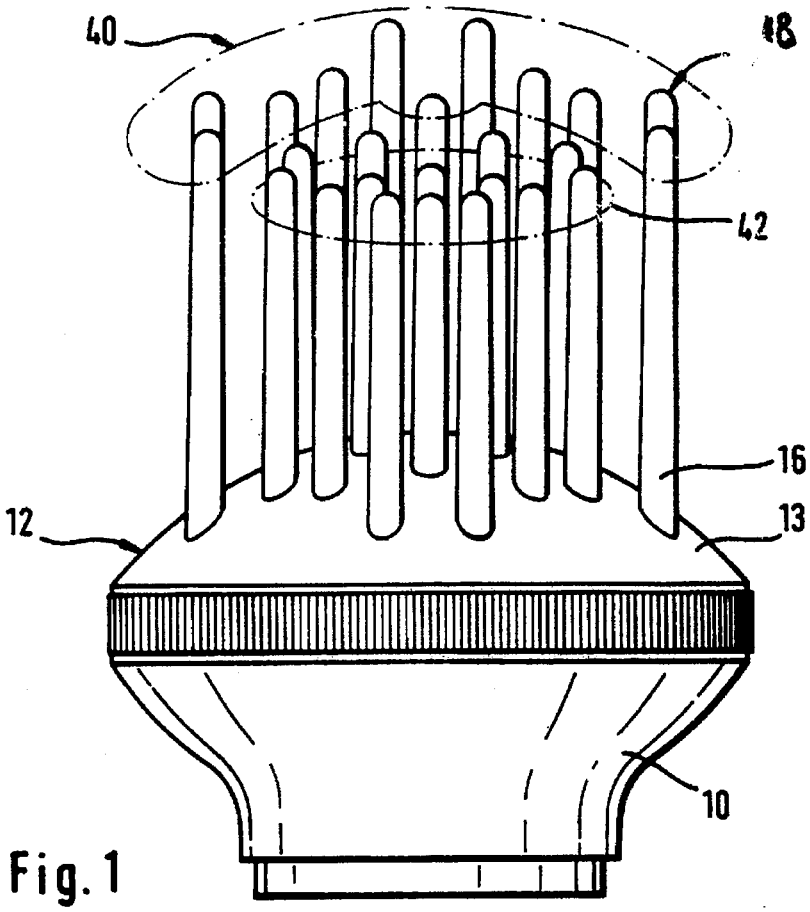
FIG. 1 is a front view of an implement illustrating a first embodiment of the present invention.
Figure 2:
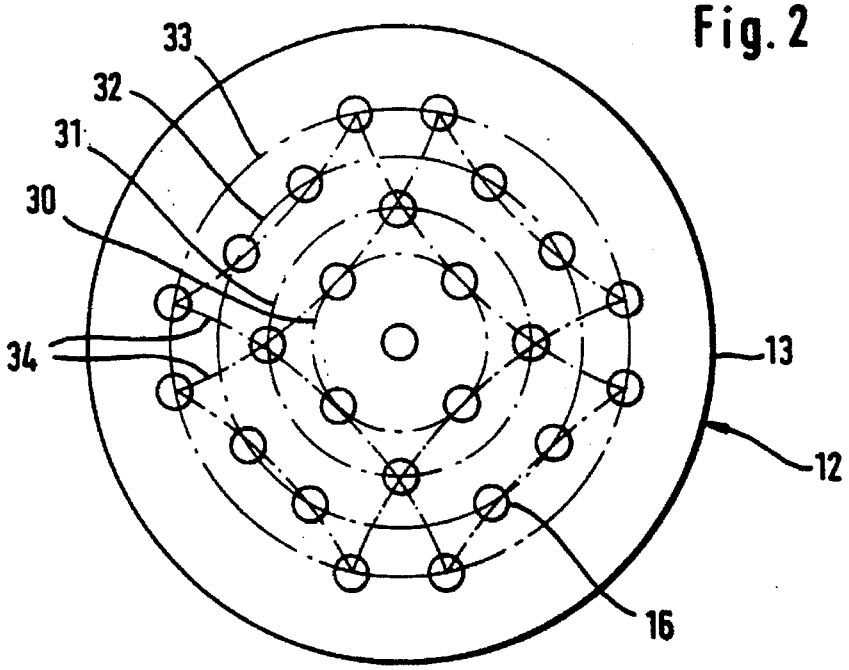
FIG. 2 is a top plan view of the implement of FIG. 1.

Referring now to FIG. 1 of the drawings, there is shown an implement for styling/drying hair, comprising a body 10 and an air discharge means 12 which are connected with each other. The air discharge means 12 includes a series of air exit apertures 14 and hair pickup elements 16 arranged adjacent to each other, the air exit apertures 14 being not shown in this Figure for clarity of illustration. The hair pickup elements 16 are of different lengths, terminating with their downstream ends 18 in a concave surface, that is, a surface curving inwardly relative to the air discharge means 12. This concave surface is a portion of a spherical surface, the sphere having a diameter corresponding approximately to the mean diameter of a person's head. It is thereby ensured that all hair pickup elements 16 of both the outer region 40 and the inner region 42 are in engagement with the scalp and that, when moving the hair dryer using an appropriate circular motion, the hair within the entire area bounded by the outer region 40 will be lifted up in the space between the hair pickup elements 16. The hair will be dried in this position, and a good stand of the hair in the root area will be accomplished. The hair will become softer and be made more voluminous. In addition to the fashioning and drying effect, the user will experience a very pleasant massage effect resulting from the engagement of all hair pickup elements 16 with the scalp and the use of a circular motion. For straightening out the hair or dry-combing longer hair, the hair styling/drying implement is held so as to engage in the hair from the side of the head, the longer length of the hair pickup elements 16 of the outer-region 40 then enabling a sufficient section of hair to be caught and divided up into individual strands by the hair pickup elements 16. The strands of hair will be pulled over the convex, that is, outwardly curving, air discharge means 12 and dried as this occurs. An attendant advantage is that the hair will also be smoothed in the process. The gliding action of the hair over the surface of the air discharge means 12 adds luster to the hair. The implement may be used as an accessory for a hair dryer, or alternatively, it may form an integral part of the hair dryer. In either event, the user has the advantage of requiring only one hand for styling/drying, the need for an additional brush being obviated.

The hair pickup elements 16 are fixedly mounted on four equidistantly disposed concentric circular rings 30, 31, 32, and 33. In addition, they are arranged on the air discharge means 12 in the form of two quadrangles 34 disposed in a 90° offset relation to each other, their sides being curved in a concave fashion, with in particular individual ones of the hair pickup elements 16 being associable with either quadrangle 34.

The concave sides of the quadrangles 34 form lines corresponding approximately to the arcs of a circle. The arrangement of the hair pickup elements 16 is selected such that, when the implement is applied from the side for performing a combing operation, it will engage the hair close to the scalp, as a result of which all hair pickup elements 16 on a side will pick up hair. Through the air exit apertures 14 not shown for clarity of illustration, streams of air will be directed at the hair, drying it.

Figure 3:
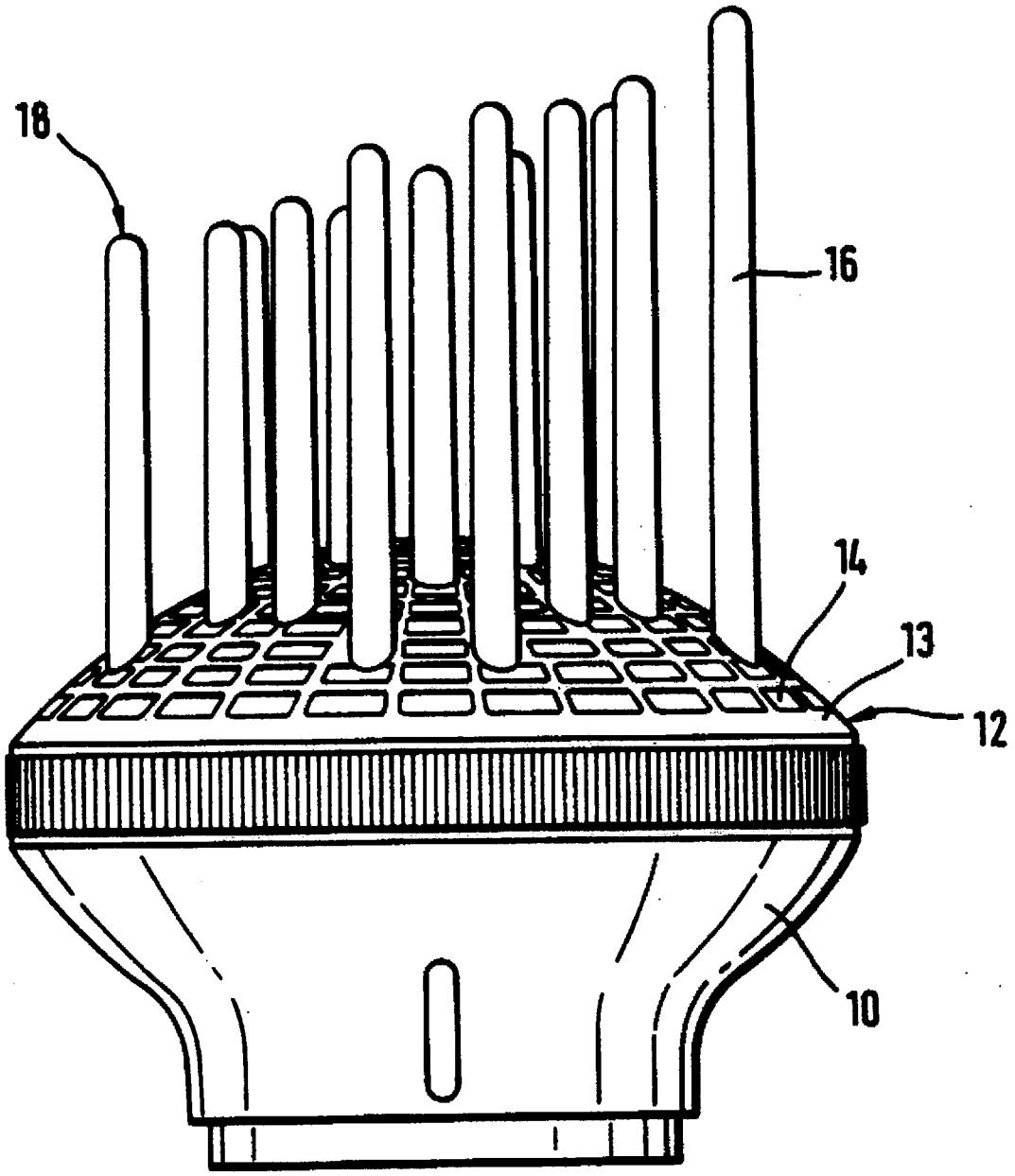
FIG. 3 is a side view of the implement of FIG. 1.

FIG. 3 shows a side view of the implement illustrating the different lengths of the hair pickup elements 16. The area of cross section 25 of the hair pickup elements 16 increases slightly starting from their downstream end 18 and continuing in the direction of the upstream end of the hair pickup elements 16 close to the air discharge means 12. In this configuration, the ratio of the length to a mean diameter of the hair pickup elements 16 is greater than 5 to 1 for the shortest one of the hair pickup elements. When a plane is applied to the ends 18 of the hair pickup elements 16, its angle of inclination relative to the front face of the hair dryer is between greater than 0° and about 30°, preferably 15°. By virtue of this inclination and the different lengths of the fingers, the user is in a position to manipulate a hair dryer to which the implement is attached with ease even in the head rear area, without the hair pickup elements 16 becoming disengaged from the scalp or the need to incline the hair dryer at an excessively sharp angle. In addition, the inclination assists the individual strands of hair in gliding up on the hair pickup elements 16. The air exit apertures 14 are approximately evenly distributed over the entire surface of the air discharge means 12.

FIG. 4 shows an air discharge means 12 which is of a plane configuration and formed by circular rib members 20. These are disposed in offset relation to each other in two planes, causing the air to be swirled whereby the velocity of flow of the exiting air is reduced. Part of these rib members 20 is in the form of annular walls 22. Downstream end portions 24 of the annular walls 22 lie on a convex surface relative to the surface of the air discharge means 12. Fixedly mounted on the rib members 20 are the hair pickup elements 16.

FIG. 5 shows a hair pickup element 16 which is of a quadrangular, preferably star-shaped cross section 25 with rounded edges 26. The diameter at the downstream end 18 of the hair pickup element 16 is slightly smaller than at the upstream end. In another configuration, the hair pickup elements may also be of a round cross section.

In a preferred embodiment, the air discharge means 12 of the implement has a diameter of about 93 mm and a radius of curvature of 60 mm. The length of the hair pickup elements 16 is between 40 mm and 70 mm, with a mean diameter of about 5 mm. The ratio of the length to the diameter of the hair pickup elements is thus between about 8 to 1 for the shortest, and about 14 to 1 for the longest, hair pickup element 16, with a total of preferably 25 hair pickup elements 16 being arranged on the air discharge means 12. The circular rings 30, 31, 32, and 33 of which the hair pickup elements 16 are disposed have a diameter of, respectively, 25 mm, 39 mm, 53 mm, and 67 mm. The ends 18 of the hair pickup elements 16 lie on a concave surface representing a portion of a spherical surface with a sphere diameter of about 210 mm. When the implement for styling/drying hair is placed on a section of hair and moved using a circular motion, this section of hair will be caught by the hair pickup elements 16 and lifted up by the hair picked up in succession, the hair winding along the hair pickup elements 16 in the process. The air discharged through the air exit apertures 14 will dry the strands of hair, providing them with a good stand in the root area and adding volume to the hair. When longer hair is combed dry, the hair will glide over the convex air discharge means 12. This hair gliding movement over the air discharge means 12 and its engagement with the hair pickup elements 16 will bring additional luster to the hair.

I claim:

1. A method for increasing volume in the hair of a user comprising the steps of:

providing, on an implement for styling hair of an air-moving appliance for personal use, a body and an air discharge means on said body, said air discharge means including a plurality of air exit apertures and carrying a plurality of prongs arranged adjacent each other and having distal ends located in an outward direction from said air discharge means, contacting the distal ends of at least a portion of the plurality of the prongs with the scalp of the user, moving the distal ends of said portion of the plurality of prongs along the scalp and between hairs, and lifting the hairs away from the scalp between said portion of the plurality of prongs while said portion of the plurality of prongs is contacting the scalp, whereby a flow of air exiting the air exit apertures dries the lifted hairs.

2. The method of claim 1, further comprising the step of rotating slightly the distal ends contacting the scalp about an axis perpendicular to the scalp.

3. The method of claim 2, wherein the step of rotating further comprises the axis perpendicular to the scalp being generally parallel to a longitudinal axis of the prongs.

4. The method of claim 1, wherein said plurality of adjacent prongs are arranged closely to each other.

5. The method of claim 1, wherein the step of providing further comprises the prongs being arranged in an inner region of the air discharge means and in an outer region of the air discharge means, and disposing the distal ends at or below an imaginary surface intersecting the distal ends of the prongs of the inner region and the distal ends of the prongs of the outer region.

6. The method of claim 5, wherein the step of providing further comprises the prongs arranged in the outer region are more outward from the air discharge means than the prongs arranged in the inner region.

7. The method of claim 1, wherein the step of providing further comprises the prongs being arranged in an inner region of the air discharge means, an outer region of the air discharge means and a central region of the air discharge means between the inner and outer regions, and disposing the distal ends of the prongs arranged in the central region not more outward than the outwardmost distal ends of the prongs of the inner and outer regions.

8. The method of claim 7, wherein the step of providing further comprises the prongs arranged in the outer region are more outward from the air discharge means than the prongs arranged in the inner region.

9. The method of claim 1, wherein the step of contacting further comprises said portion being more than a minor portion of the plurality of prongs.

10. The method of claim 1, wherein the step of providing further comprises the prongs having a ratio of the length of the prongs to a mean diameter thereof greater than 5 to 1.

11. The method of claim 10, wherein the ratio is at least 8 to 1.

12. The method of claim 1, further comprising the step of catching the hairs between prongs of said portion of the plurality of prongs having distal ends moving along the scalp, and wherein the step of lifting further comprises lifting the hairs so caught away from the scalp.

13. The method of claim 1, wherein the step of providing further comprises the step of disposing a plurality of the distal ends of the prongs to intersect a substantially concave surface, said substantially concave surface being concave relative to a location that is in the outward direction from said distal ends.

14. The method of claim 1, wherein the step of providing further comprises the prongs having a longitudinal axis extending in said outward direction to said distal ends and disposing a plurality of the distal ends of the prongs to intersect a substantially inclined planar surface, said substantially inclined planar surface being inclined relative to said longitudinal axis.

15. A method for increasing volume in the hair of a user comprising the steps of:

providing, on an implement for styling hair of an air-moving appliance for personal use, a body and an air discharge means on said body, said air discharge means including a plurality of air exit apertures and carrying a plurality of prongs arranged adjacent each other and having distal ends located in an outward direction from said air discharge means, wherein a plurality of the distal ends of the prongs intersects a substantially concave surface, said substantially concave surface being concave relative to a location that is in said outward direction from said distal ends, contacting the distal ends of at least a portion of the plurality of the prongs with the scalp of the user, moving the distal ends of said portion of the plurality of prongs along the scalp and between hairs, and lifting the hairs away from the scalp between said portion of the plurality of prongs contacting the scalp, whereby a flow of air exiting the air exit apertures dries the lifted hairs.

16. The method of claim 15, further comprising the step of rotating slightly the distal ends contacting the scalp about an axis perpendicular to the scalp.

17. The method of claim 15, wherein the step of providing further comprises the prongs having a ratio of the length of the prongs to a mean diameter thereof greater than 5 to 1.

18. The method of claim 17, wherein the ratio is at least 8 to 1.

19. The method of claim 17, wherein the ratio is at least 8 to 1.

20. A method for increasing volume in the hair of a user comprising the steps of:

providing, on an implement for styling hair of an air-moving appliance for personal use, a body and an air discharge means on said body, said air discharge means including a plurality of air exit apertures and carrying a plurality of prongs arranged adjacent each other and having distal ends located in an outward direction from said air discharge means, wherein the prongs having a longitudinal axis extending in said outward direction to said distal ends and a plurality of the distal ends of the prongs intersects a substantially inclined planar surface, said substantially inclined planar surface being inclined relative to said longitudinal axis, contacting the distal ends of at least a portion of the plurality of the prongs with the scalp of the user, moving the distal ends of said portion of the plurality of prongs along the scalp and between hairs, and lifting the hairs away from the scalp between said portion of the plurality of prongs contacting the scalp, whereby a flow of air exiting the air exit apertures dries the lifted hairs.

21. The method of claim 20, further comprising the step of rotating slightly the distal ends contacting the scalp about an axis perpendicular to the scalp.

22. The method of claim 20, wherein the step of providing further comprises the prongs having a ratio of the length of the prongs to a mean diameter thereof greater than 5 to 1.

* * * * *